US006306070B1

(12) United States Patent
Herrin

(10) Patent No.: US 6,306,070 B1
(45) Date of Patent: Oct. 23, 2001

(54) APPARATUS FOR ERECTING AND SEALING FLAT CONTAINERS AND ASSOCIATED METHODS

(76) Inventor: Robert M. Herrin, 5935 Groveline Dr., Orlando, FL (US) 32810

( * ) Notice: Subject to any disclaimer, the term of this patent is extended or adjusted under 35 U.S.C. 154(b) by 0 days.

(21) Appl. No.: 09/474,172

(22) Filed: Dec. 29, 1999

(51) Int. Cl.[7] ..... B31B 1/12
(52) U.S. Cl. ..... 493/125; 493/177; 493/316
(58) Field of Search ..... 493/123, 125, 493/126, 127, 131, 177, 178, 182, 183, 316, 319, 317

(56) References Cited

U.S. PATENT DOCUMENTS

| | | | | |
|---|---|---|---|---|
| 2,082,565 | | 6/1937 | Benoit | 93/6 |
| 2,160,518 | | 5/1939 | Reynolds | 93/6 |
| 2,523,667 | | 9/1950 | Palmer et al. | 93/3 |
| 2,966,020 | | 12/1960 | Bacsak | 53/128 |
| 3,640,190 | | 2/1972 | Fuller et al. | 49/2 |
| 3,818,676 | | 6/1974 | Russell et al. | 19/18 |
| 3,821,874 | | 7/1974 | Jones | 53/27 |
| 4,089,150 | | 5/1978 | Heisler | 53/29 |
| 4,137,830 | | 2/1979 | Boyd | 93/55 |
| 4,237,777 | | 12/1980 | Nowacki et al. | 493/100 |
| 4,262,794 | | 4/1981 | Bourgeois | 198/459 |
| 4,682,684 | | 7/1987 | Lothman | 198/461 |
| 4,917,659 | | 4/1990 | Mohaupt et al. | 493/12 |
| 4,998,399 | | 3/1991 | Lutzke et al. | 53/398 |
| 5,106,359 | * | 4/1992 | Lott | 493/125 |
| 5,379,570 | | 1/1995 | Terjung et al. | 53/399 |
| 5,393,291 | * | 2/1995 | Wingerter | 493/116 |
| 5,588,285 | | 12/1996 | Odenthal | 53/534 |
| 5,897,480 | * | 4/1999 | Pazdernik | 493/316 |
| 5,916,078 | * | 6/1999 | Herrin | 493/93 |
| 6,070,396 | * | 6/2000 | Rinaldi et al. | 53/504 |
| 6,106,450 | * | 8/2000 | Brittain | 493/171 |

* cited by examiner

*Primary Examiner*—Peter Vo
*Assistant Examiner*—Hemant M. Desai
(74) *Attorney, Agent, or Firm*—Allen, Dyer, Doppelt, Milbrath & Gilchrist, P.A.

(57) ABSTRACT

A container erecting apparatus and methods are provided which advantageously increase the efficiency and production speed of erecting and sealing containers. The apparatus preferably includes a dispenser positioned to dispense one of a plurality of collapsed containers to be transported along a first predetermined path of travel and collapsed container erecting means positioned downstream from the dispenser for erecting the collapsed container. The apparatus also includes a first bottom panel folder and a container advancer positioned downstream from the container erecting means along the first predetermined path of travel. A second panel folder is positioned downstream and on a second predetermined path of travel which is transverse to the first predetermined path of travel. The apparatus also includes a container conveyor which is positioned along the second predetermined path of travel on which the apparatus has a third panel folder, an adhesive applicator for applying adhesive to selected portions of the folded panels, and a container compressor positioned downstream from the adhesive applicator along the second predetermined path of travel for compressing and sealing the bottom panels in a closed position.

30 Claims, 4 Drawing Sheets

TO CONTROLLER
60
62
63
64
65
66
67
68
72
B
E
10

APPARATUS FOR ERECTING AND SEALING FLAT CONTAINERS AND ASSOCIATED METHODS

FIELD OF THE INVENTION

The present invention relates to the field of containers and container systems, and, more particularly, to a container erecting and sealing apparatus and associated methods.

BACKGROUND OF THE INVENTION

In many industries where products are produced, packed, stored, or shipped to various locations, these products are produced or stored in warehouses from which to be distributed to customers or retailers. These products, e.g., produce, are often placed in cartons or boxes made of cardboard or other materials to be stored in or shipped from the warehouses. Because of the various demands on these suppliers, such as need for more timely deliveries, for lower or more control of labor costs, space for expanding production, and space for storing more products, problems have arisen at various stages of these processes One of the areas where problems have arisen is in the supply speed and control of the containers used in the shipping and storage of products. The erecting and sealing of the containers used for storage and shipping can be time consuming, particularly in the industries where the needs are for increased speed without damage to the containers being readied for use. The machines used for this purpose can also be large, occupy a lot of square footage of a warehouse facility, be complex, and have increased mechanical reliability problems.

SUMMARY OF THE INVENTION

With the foregoing in mind, the present invention advantageously provides a container erecting and sealing apparatus and methods for erecting and sealing collapsed or flat containers at higher speeds. The present invention also advantageously provides a container erecting and sealing apparatus and methods for erecting and sealing collapsed or flat containers which occupy less foot print or space on a production, packaging, or manufacturing floor. The present invention further advantageously provides a container erecting and sealing apparatus and methods which enhances control over the erecting and sealing of collapsed or sealed containers.

More particularly, a container erecting and sealing apparatus for enhancing the production speed of container erecting and sealing according to the present invention preferably includes collapsed container erecting means for erecting each of a plurality of collapsed containers during travel along a first predetermined path. The plurality of collapsed containers each preferably have a plurality of non-folded bottom panels. The apparatus also includes first bottom panel folding means positioned in the first predetermined path of travel for folding a pair of the plurality of non-folded bottom panels. The bottom panel folding means also includes bottom panel positioning and container advancing means positioned to move the pair of the plurality of non-folded bottom panels of each erected container inwardly toward each other and advance the erected container downstream along the first predetermined path of travel. The apparatus additionally includes second bottom panel folding means positioned to overlie at least one of the non-folded bottom panels of an erected container and downstream from the first bottom panel folding means along the first predetermined path of travel for inwardly folding the at least one of the non-folded bottom panels downwardly to thereby contact the folded bottom panels, conveying means positioned along a second predetermined path of travel transverse to the first predetermined path of travel for receiving and conveying the plurality of erected containers along the second predetermined path of travel, and third bottom panel folding means positioned adjacent the conveying means along the second predetermined path of travel for folding a remaining non-folded bottom panel inwardly to a position closely adjacent the previously folded bottom panels. The apparatus further includes adhesive applying means positioned downstream from the third bottom panel folding means along the second predetermined path of travel for applying adhesive only to selected portions of the bottom panels and compressing means positioned downstream from the adhesive applying means along the second predetermined path of travel for compressing surfaces of the bottom panels to thereby seal the bottom panels in a closed position.

The present invention also advantageously includes methods of erecting and sealing containers. A method preferably includes receiving a plurality of erected containers from a first predetermined path of travel, conveying the plurality of erected containers along a second predetermined path of travel, folding at least one non-folded bottom panel of each of the plurality of erected containers inwardly toward a closed position during travel along the second predetermined path of travel, applying adhesive only to selected portions of bottom panels of each of the plurality of erected containers during travel along the second predetermined path of travel, and compressing surfaces of the bottom panels of each of the plurality of erected containers along a second predetermined path of travel to thereby seal the bottom panels in a closed position.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

Figure 1:
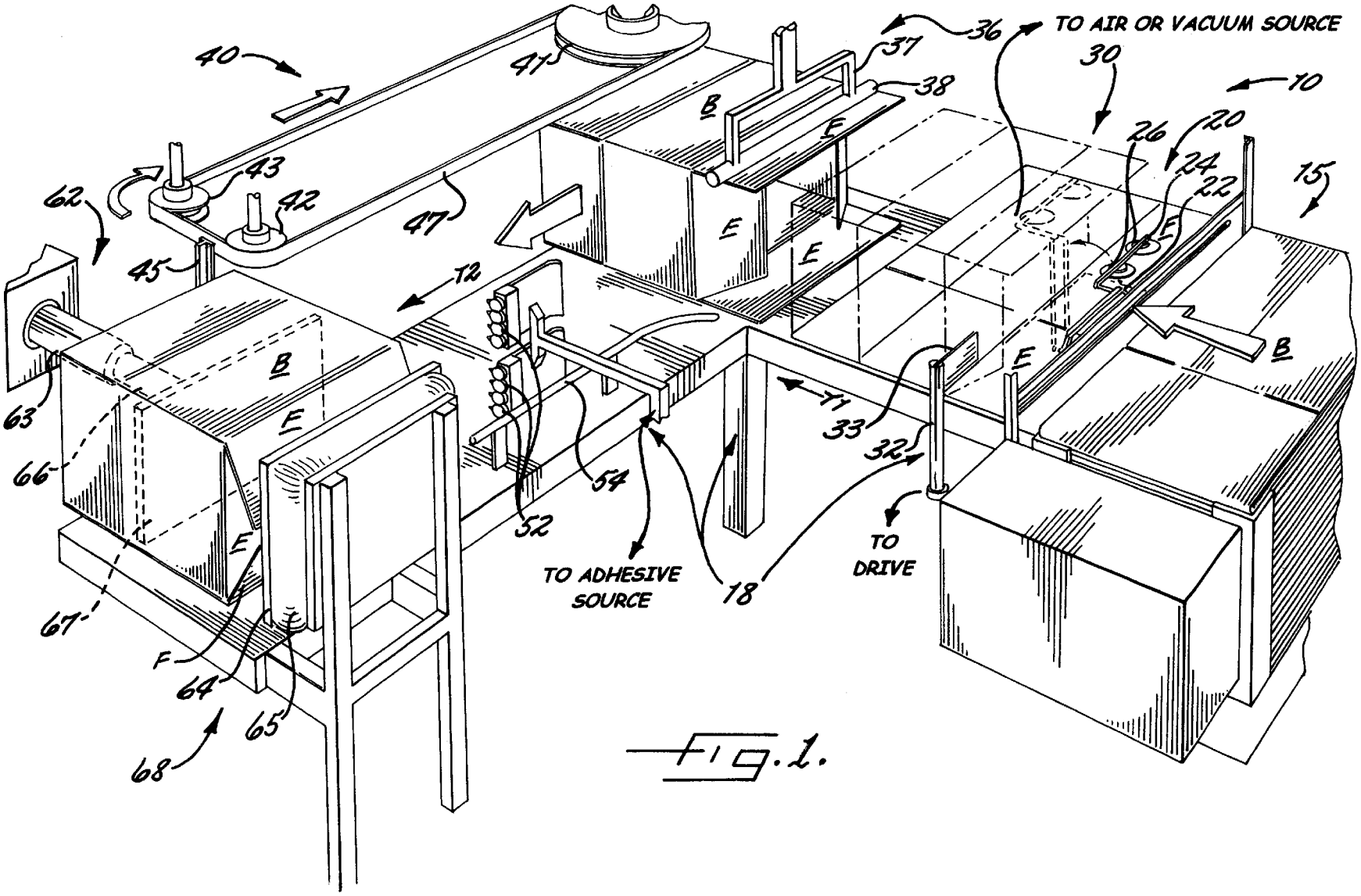
FIG. 1 is a perspective view of an apparatus for erecting and sealing a flat container according to the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments FIG. 1 illustrates an apparatus 10 for erecting and sealing a container B according to the present invention. The apparatus 10 preferably has collapsed container dispensing means 15, e.g., preferably provided by a collapsed or flat container dispenser, which supplies and dispenses collapsed containers B, e.g., rectangular-shaped boxes, preferably one at a time along a first predetermined path of travel T1 as illustrated. The dispensing means 15 preferably has a plurality of flat containers B positioned in a loading rack 16 and slidably moves a single flat container B under a guide bar 17 such as by the use of a pushing arm which contacts only one flat container and pushes it forwardly or downstream along the predetermined path of travel T1. In addition to a pushing arm, other mechanical dispensing mechanisms or actuators can be used as well as understood by those skilled in the art. The dispensing means 15 preferably dispenses and conveys the collapsed containers B along the first path of travel T1 into a position to be erected by container erecting means 20 positioned downstream from the dispensing means 15 along the first predetermined path of travel T1.

As illustrated, each of the containers B, for example, can be a rectangular shaped box which has a front panel, a rear panel, and a pair of major side panels connected by a plurality of common fold lines, a pair of major top panels or flaps each connected to and extending outwardly from a respective one of the pair of major side panels along common fold lines, a pair of minor top panels or flaps each connected to and extending outwardly from a respective one of the front and rear panels along common fold lines, a pair of major bottom panels or flaps F each connected to and extending outwardly from a respective one of the pair of major side panels along common fold lines, and a pair of minor bottom panels or flaps F each respectively connected to one of the front and rear panels along common fold lines. Such containers are well understood by those skilled in the art for use in the produce, packaging, and other industries.

As shown in FIG. 1, the container erecting means 20 preferably has a pivotal lifting arm 22. The proximal end of the lifting arm 22 is preferably connected to a frame 18 of the apparatus, and a distal end of the lifting arm 22 is preferably pivotally connected to a second pivotal arm 24 having one or more suction devices or members 26 attached thereto. The suction devices 26 are preferably suction cups that preferably have an air or vacuum connected thereto to assist with the engagement and lifting of the containers as understood by those skilled in the art. Air or vacuum assist may also not be required or desired in other embodiments of the present invention. The container erecting means 20 preferably engages or contacts a panel of each dispensed collapsed container B by the suction devices 26 and lifts a panel, e.g., a front, rear, or side panel, of the collapsed container B pivotally upward on an arcuate path of travel P1 lifting the container B into an erect position (see phantom lines of FIG. 1).

Figure 2:
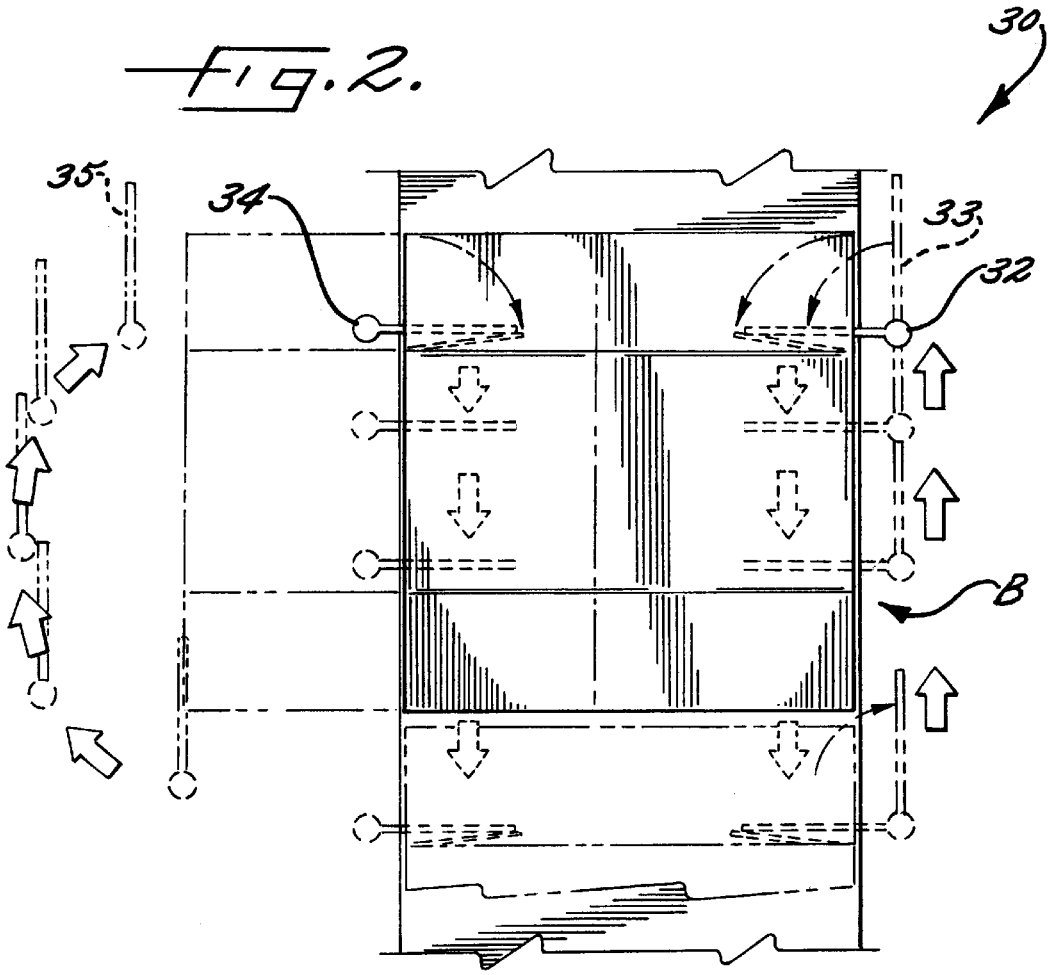
FIG. 2 is a fragmentary top plan view of a conveyor transporting a container along a first predetermined path of travel and a side panel folder of an apparatus for erecting and sealing a flat container according to the present invention.

As shown in FIGS. 1–2, the apparatus 10 also has first bottom panel folding means 30, e.g., a first bottom panel folder assembly, which preferably includes bottom panel positioning and container advancing means positioned to move the pair of the plurality of non-folded bottom panels F of each erected container B inwardly toward each other and advance the erected container B downstream along the first predetermined path of travel T1 while another collapsed or flat container B is being dispensed to the container erecting means 20. The bottom panel positioning and container advancing means preferably includes driving means, e.g., a motor, drive gears, and a drive chain or assembly as understood by those skilled in the art, connected to a pair of arms or arm members 32, 34 located on both opposing sides of the first path of travel T1. Each of these arms 32, 34 preferably has a flattened paddle or plate member 33, 35 pivotally mounted at an upper or distal end of the arm 32, 34. These paddles 33, 35 when moved synchronously toward each other contact at least a pair of the non-folded bottom panels F and fold these panels F inwardly as the container B travels downstream along the first predetermined path of travel T1. These paddles 33, 35 of the arms 32, 34 when moved synchronously toward each other contact at least a pair of the non-folded bottom panels F and fold these panels inwardly as illustrated. These paddles 33, 35 then assist in guiding and conveying, e.g., slidably moving along a planar surface of the frame 18 as shown, the erected container B along the first path of travel T1 to second bottom panel folding means 36. As perhaps most clearly seen in FIG. 2, the paddles 33, 35 of the arms 32, 34 then pivot out of the path of travel and then are moved by the driving means to an original starting position. The process is then repeated for the next container B.

Figure 3:
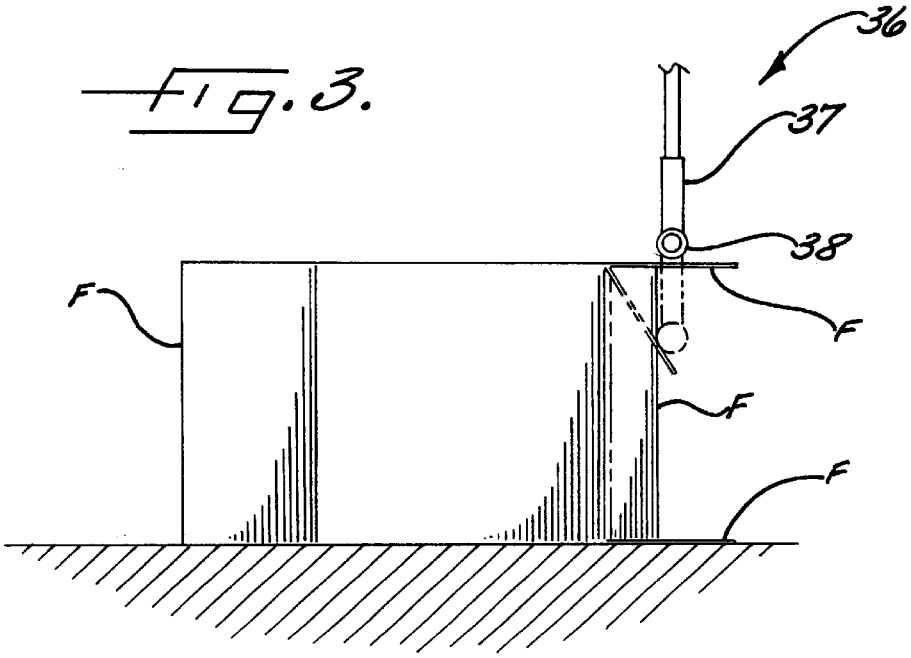
FIG. 3 is a side elevational view of an upper bottom panel folder positioned along a first predetermined path of travel of a container traveling through an apparatus for erecting and sealing a flat container according to the present invention.

FIGS. 1 and 3 best illustrate the second bottom panel folding means 36, e.g., preferably provided by a second bottom panel folder assembly, which is located above the containers B during travel along the first path of travel T1. The second bottom panel folding means 36 preferably is provided by a panel contact member, e.g., a bar, 38 which is positioned transverse to the first path of travel T1 and is substantially parallel to the second path of travel T2 and arms 37 connected to the panel contact member 38 and attached to a bar retractor and extender, e.g., a piston-type actuator, as understood by those skilled in the art, for extending the bar downward and retracting the bar upward during folding of the bottom panel. The second bottom panel folding means 36, as seen in FIG. 3, extends downwardly folding at least one of the non-folded bottom panels F inwardly toward a closed position thereby contacting the folded bottom panels F when yet another erected container B is being advanced upstream therefrom.

Figures 4, 5:
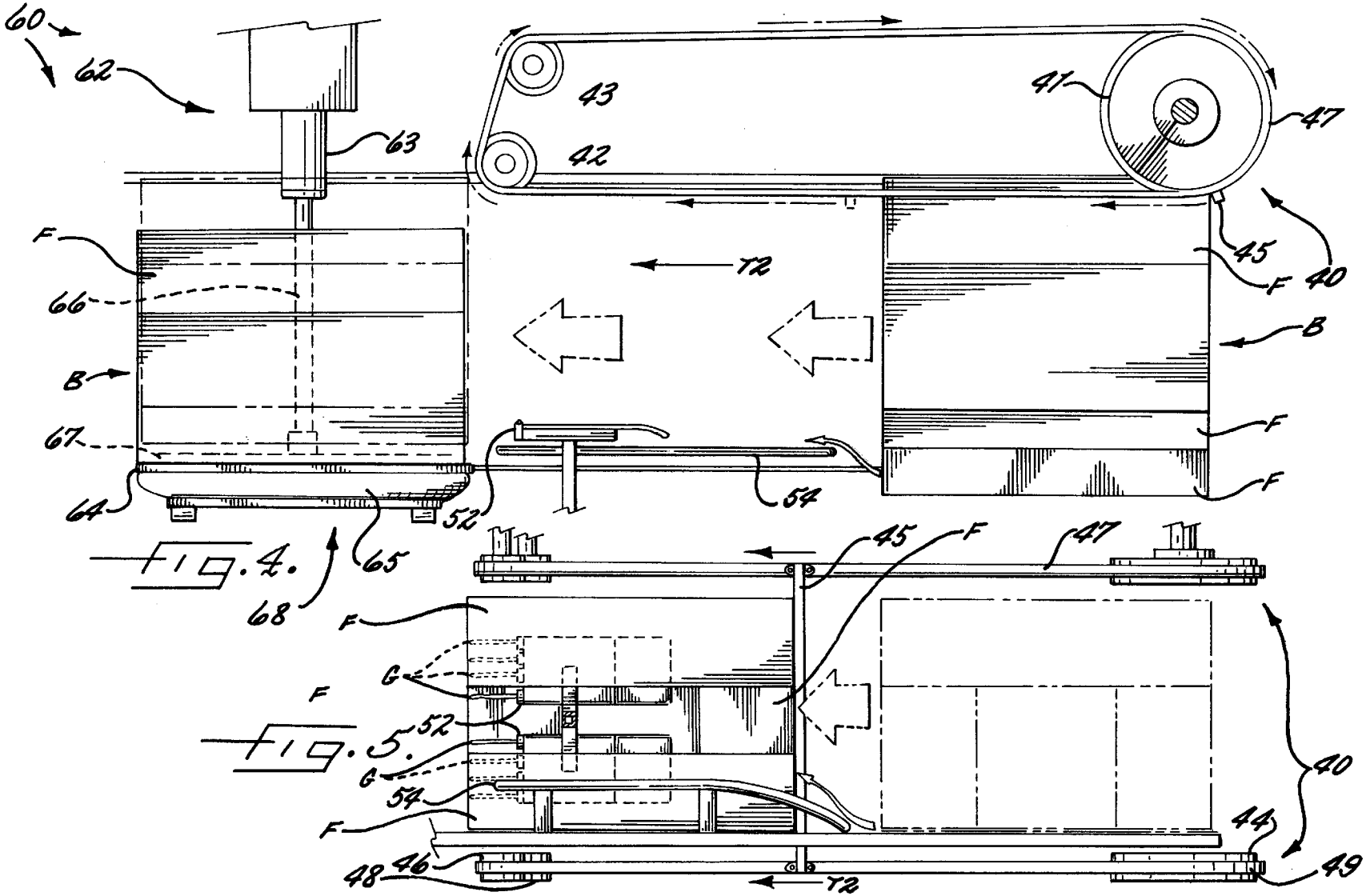
FIG. 4 is a fragmentary top plan view of a conveyor transporting a container along a second predetermined path of travel, an adhesive applicator, and a panel compressor of an apparatus for erecting and sealing a flat container according to the present invention.
FIG. 5 is a fragmentary side plan view of a conveyor transporting a container along a second predetermined path of travel, a bottom panel folder, and an adhesive applicator of an apparatus for erecting and sealing a flat container according to the present invention.

As best illustrated in FIGS. 1, 4, and 5, the apparatus 10 also includes conveying means 40, e.g., a container conveyor, for conveying or transporting the erected containers along the second predetermined path of travel T2 which is transverse, e.g., substantially perpendicular, to the first predetermined path of travel T1. The conveying means 40, e.g., a container conveyor, preferably conveys the containers B along the second predetermined path of travel T2 while other containers B are being dispensed, erected, advanced, and folded along the first predetermined path of travel T1. The conveying means 40 preferably includes driving means, e.g., a motor, drive wheels, e.g., at least three wheels 41, 42, 43, mounted above the path of travel of the erected container and three wheels 44, 46, 48 mounted below the path of travel of the erected container B. The conveying means 40 also preferably includes a belt or chain 47 mounted on the three upper wheels 41, 42, 43 and a belt or chain 49 mounted on the three lower wheels 44, 46, 48. The conveying means 40 also includes a container advancer, e.g., an elongate member 45 extending transversely outwardly from the upper belt or chain 47 as illustrated. The container advancer 45 can also be connected at an upper end to the upper belt or chain 47 and if desired, also connected at its lower end to the lower belt or chain 49. Both the upper belt or chain 47 and the lower belt or chain 49 can run synchronously in a predetermined path around the upper wheels 41, 42, 43 and lower wheels 44, 46, 48. This path, in part, overlies and underlies the second predetermined path of travel T2 of the erected container B (see FIGS. 1 and 5). The elongate member 45 connected to the upper and lower belts contacts the erected container B and slidably conveys the container along the second predetermined path of travel T2 along the substantially planar upper surface of a table of the frame 18 as illustrated.

FIGS. 1, 4, and 5 also illustrate third panel folding means which preferably includes a panel guide 54. The panel guide 54 is preferably a bar mounted to the frame and has a portion thereof arcuately extending downwardly toward the planar surface of the table of the frame 18 as illustrated. As the container B slidably advances from the first path of travel T1 along the second path of travel T2, the panel guide 54 abuttingly contacts a panel F of the container B so that movement of the container B in contact with the panel guide 54 forces the panel F inwardly to a folded position as shown.

The apparatus 10 also has adhesive applying means 52, e.g., preferably provided by an adhesive applicator such as one or more glue heads positioned adjacent a container, positioned downstream from the third panel folding means, i.e., the panel guide 54, along the second predetermined path of travel T2 for applying adhesive, e.g., glue G, to selected portions of the bottom panels F as the erected containers B travel along the second predetermined path of travel T2. As understood by those skilled in the art, the adhesive applicator 52 has adhesive or glue heads connected to tubes or supply lines. The tubes or supply lines, in turn, are connected to an adhesive source as understood by those skilled in the art. The adhesive is preferably heated to allow the adhesive to readily flow through the supply lines, to the glue heads, and to surfaces of the bottom panels.

Figure 6:
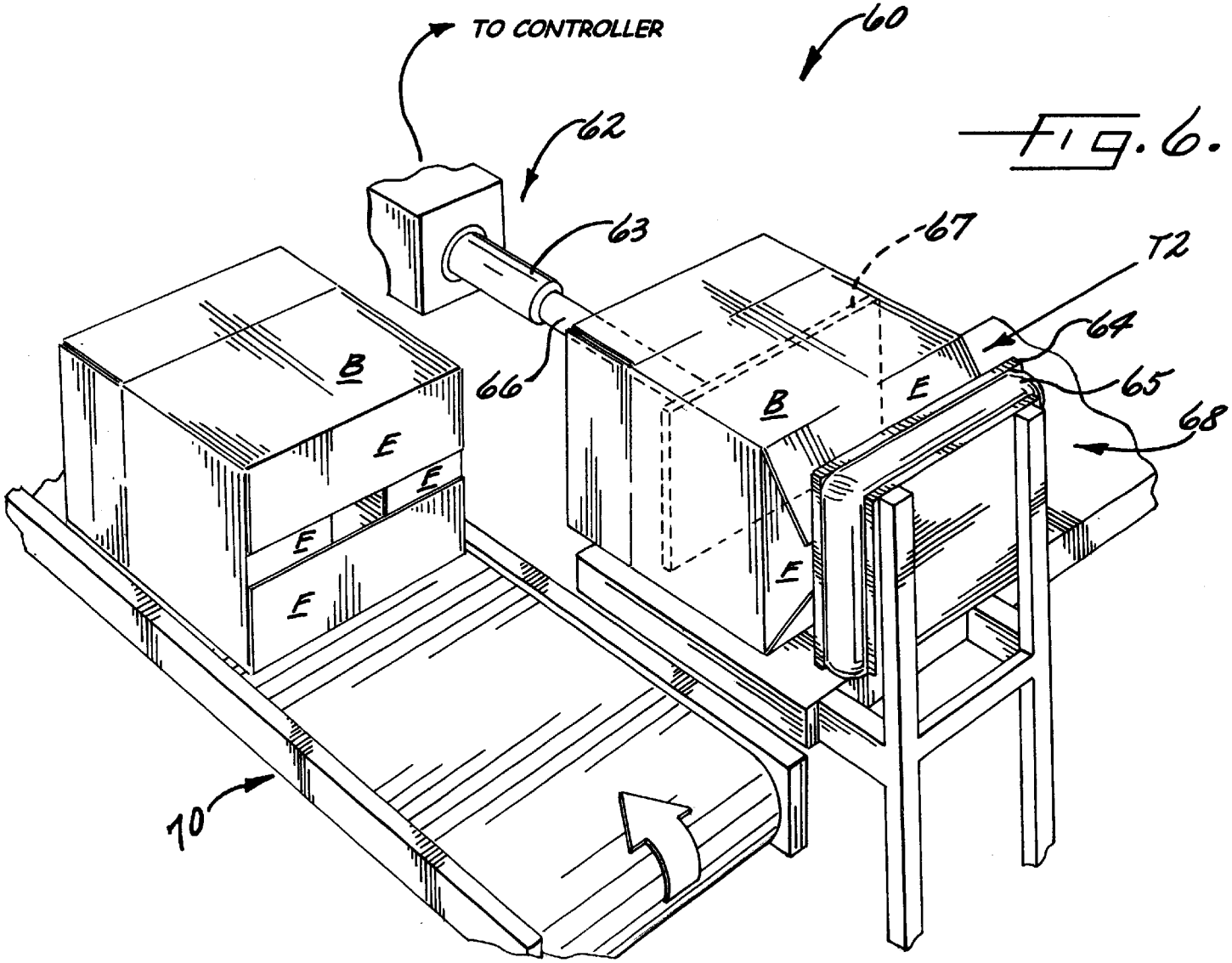
FIG. 6 is a perspective view of a panel compressor positioned to compress panels of a container along a second predetermined path of travel and a conveyor for conveying an erected and sealed container along a third predetermined path of travel.

The apparatus 10 still further has compressing means 60, e.g., preferably provided by a panel compressor, as perhaps best illustrated by FIGS. 1, 4, and 6, positioned downstream from the adhesive applicator 52 along the second predetermined path of travel T2 and which preferably has a bottom panel compressing member 62 having an extending and retracting means 63, e.g., a pressurized piston and piston chamber or actuator as understood by those skilled in the art, connected by an elongate shaft 66 to the bottom panel compressing member 67. The compressing means 60 also has a wall member 68 positioned separate from the extending and retracting means 63 and including a flat panel 64 mounted to a cushion 65 for even compression. After the bottom panels F are compressed or sealed, the container B then advances to another conveyor 70 positioned for conveying the sealed and erected container B along a third predetermined path of travel T3 (see FIG. 6). Additionally, as understood by those skilled in the art, one or more controllers, e.g., microprocessors, micro-controllers, optical encoders, switches, sensors, and/or computers, are preferably used to control the synchronization and flow of the various elements of the apparatus 10 as the plurality of containers travel therethrough.

As shown in FIGS. 1–6, the present invention also includes a method of erecting and sealing a collapsed or flat container B for enhancing the production speed of container erecting and sealing. A method preferably includes erecting each of a plurality of collapsed containers B during travel along a first predetermined path T1. The plurality of collapsed containers B each preferably has a plurality of non-folded bottom panels F. The method also includes inwardly folding a pair of the plurality of non-folded bottom panels F of each of the plurality of erected containers B during advancement of the erected container downstream along the first predetermined path of travel T1, inwardly folding the at least one of the non-folded bottom panels F of each of the plurality of erected containers B downwardly to thereby contact the folded bottom panels F when each of the plurality of erected containers B is positioned along the first predetermined path of travel T1, conveying the plurality of erected containers B along a second predetermined path of travel T2, and folding a remaining non-folded bottom panel F of each of the plurality of erected containers B inwardly to a position closely adjacent the previously folded bottom panels F when the plurality of erected containers B travel along the second predetermined path of travel T2. The method further preferably includes applying adhesive G only to selected portions of the bottom panels F when each of the plurality of erected containers B travel along the second predetermined path of travel T2 and compressing surfaces of the bottom panels F when each of the plurality of erected containers B travel along the second predetermined path of travel T2 to thereby seal the bottom panels F in a closed position. The method can also include individually dispensing a plurality of stacked collapsed containers B along the first predetermined path of travel T1 prior to the step of erecting the plurality of collapsed containers B.

Another method of erecting and sealing containers B according to the present invention preferably includes receiving a plurality of erected containers B from a first predetermined path of travel T1, conveying the plurality of erected containers B along a second predetermined path of travel T2, folding at least one non-folded bottom panel F of each of the plurality of erected containers B inwardly toward a closed position during travel along the second predetermined path of travel T2, applying adhesive only to selected portions of bottom panels F of each of the plurality of erected containers B during travel along the second predetermined path of travel T2, and compressing surfaces of the bottom panels F of each of the plurality of erected containers B along the second predetermined path of travel T2 to thereby seal the bottom panels F in a closed position. The method can also include receiving each of the plurality of erected and sealed containers B and conveying each of the plurality of erected and sealed containers B along a third predetermined path of travel T3.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That claimed is:

1. A container erecting and sealing apparatus for enhancing the production speed of container erecting and sealing, the apparatus comprising:

collapsed container erecting means for erecting each of a plurality of collapsed containers during travel along a first predetermined path, the plurality of collapsed containers each having a plurality of non-folded bottom panels;

first bottom panel folding means positioned in the first predetermined path of travel for folding a pair of the plurality of non-folded bottom panels, said bottom panel folding means including bottom panel positioning and container advancing means positioned to move the pair of the plurality of non-folded bottom panels of each erected container inwardly toward each other and advance the erected container downstream along the first predetermined path of travel;

second bottom panel folding means positioned to overlie at least one of the non-folded bottom panels of an erected container and downstream from the first bottom panel folding means along the first predetermined path of travel for inwardly folding the at least one of the non-folded bottom panels downwardly to thereby contact the folded bottom panels;

conveying means positioned along a second predetermined path of travel transverse to the first predetermined path of travel for receiving and conveying the plurality of erected containers along the second predetermined path of travel;

third bottom panel folding means positioned adjacent said conveying means along the second predetermined path of travel for folding a remaining non-folded bottom panel inwardly to a position closely adjacent the previously folded bottom panels;

adhesive applying means positioned downstream from the third bottom panel folding means along the second predetermined path of travel for applying adhesive only to selected portions of the bottom panels; and compressing means positioned downstream from adhesive applying means along the second predetermined path of travel for compressing the outer surfaces of the bottom panels to thereby seal the bottom panels in a closed position, the compressing means having portions thereof extending into the erected containers to abuttingly contact portions of the bottom panels and retracting out of the erected containers after compressing the outer surfaces of the bottom panels so as to allow another erected container to receive portions of the compressing means.

2. An apparatus as defined in claim 1, wherein said container erecting means comprises a container panel lifter positioned to engage and lift a panel of the collapsed container so that the panel is lifted along an arcuate path of travel from a collapsed position to an erected position.

3. An apparatus as defined in claim 2, further comprising a frame, and wherein the container panel lifter includes at least one lifting arm member pivotally connected to the frame and a suction member connected to the lifting arm member for suctionly engaging the panel of the collapsed container.

4. An apparatus as defined in claim 1, wherein said panel positioning and container advancing means includes a pair of upwardly extending arm members, an arm member driving means connected to the pair of arm members for driving the arm members between a position adjacent the dispensing means and a position adjacent the second bottom panel folding means, and a plate member connected to and extending outwardly from each of the arm members and positioned to pivotally contact the pair of bottom panels to thereby move the pair of bottom panels inwardly therefrom.

5. An apparatus as defined in claim 1, wherein said second bottom panel folding means includes an elongate panel contact member positioned to overlie an erected container to contact the non-folded bottom panel to thereby fold the bottom panel inwardly toward a closed positioned.

6. An apparatus as defined in claim 1, wherein the third bottom panel folding means includes a panel guide positioned adjacent said adhesive applying means to guidingly lift the non-folded bottom panel inwardly to a folded position.

7. An apparatus as defined in claim 1, wherein the compressing means includes a wall member, a bottom panel compressing member spaced-apart from the wall member so that a container can readily be positioned therebetween, and retracting and extending means connected to the bottom panel compressing member for extending the compressing member into contact with surfaces of the bottom panel and for retracting the compressing member to a position so that another erected container can be positioned between the compressing member and the wall member.

8. An apparatus as defined in claim 1, wherein the conveying means includes an erected container guide and a drive connected to the erected container guide for driving the guide along the second predetermined path of travel between a position adjacent the second bottom panel closing means and a position adjacent said adhesive applying means.

9. An apparatus as defined in claim 1, wherein said adhesive applying means includes at least one glue head positioned to apply glue to the selected portions of the bottom panels, the apparatus further comprising a third predetermined path of travel for conveying erected and sealed containers.

10. An apparatus as defined in claim 1, wherein the third bottom panel folding means also includes an upper panel guide member for further guiding the upper bottom panel folded by the second bottom panel folding means to a further folded position whereby the upper bottom panel abuttingly contacts the first to be folded bottom panels.

11. A container erecting and sealing apparatus for enhancing the production speed of container erecting and sealing, the apparatus comprising:

collapsed container dispensing means for dispensing one of a plurality of stacked collapsed containers, the one collapsed container having a front panel, a rear panel and a pair of major side panels connected by a plurality of common fold lines, a pair of major top panels each connected to and extending outwardly from a respective one of the pair of major side panels along common fold lines, a pair of minor top panels each connected to and extending outwardly from a respective one of the front and rear panels along common fold lines, a pair of major bottom panels each connected to and extending outwardly from a respective one of the pair of major side panels along common fold lines, and a pair of minor bottom panels each respectively connected to one of the front and rear panels along common fold lines, the pairs of major and minor top panels and the pairs of major and minor bottom panels respectively define a plurality of top panels and a plurality of bottom panels;

collapsed container erecting means positioned downstream from said collapsed container dispensing means on a first predetermined path of travel for erecting the one collapsed container during travel along the first predetermined path;

first bottom panel folding means positioned in the first predetermined path of travel for folding at least a pair of the plurality of bottom panels inwardly toward a closed position, said bottom panel folding means including bottom panel positioning and container advancing means positioned along opposing sides of the erected container to move at least a pair of the plurality of bottom panels of each erected container inwardly toward each other and advance the erected container downstream along the first predetermined path of travel, said bottom panel positioning and container advancing means including a pair of upwardly extending arm members, an arm member driving means connected to the pair of arm members for driving the arm members between a position adjacent the dispensing means and a position adjacent the second bottom panel folding means, and a flap member connected to and extending outwardly from each of the arm members and positioned to pivotally contact a pair of bottom panels to thereby move the pair of bottom panels inwardly therefrom;

second bottom panel folding means positioned to overlie at least one of the non-folded bottom panels of the erected container and downstream from the first bottom panel folding means along the first predetermined path of travel for inwardly folding the at least one of the non-folded bottom panels downwardly to thereby contact the folded bottom panels;

conveying means positioned along a second predetermined path of travel transverse to the first predetermined path of travel for receiving and conveying the erected container along the second predetermined path of travel;

third bottom panel folding means positioned adjacent said conveying means along the second predetermined path of travel for folding the remaining non-folded bottom panel inwardly to a position closely adjacent to previously folded bottom panels;

adhesive applying means positioned downstream from the third bottom panel folding means along the second predetermined path of travel for applying adhesive only to selected portions of the bottom panels; and compressing means positioned downstream from said adhesive applying means for compressing the outer surfaces of the bottom panels to thereby seal the bottom panels in a closed position.

12. An apparatus as defined in claim 11, wherein said container erecting means comprises a container panel lifter positioned to engage and lift a panel of the collapsed container so that the panel is lifted along an arcuate path of travel from a collapsed position to an erected position.

13. An apparatus as defined in claim 12, further comprising a frame, and wherein the container panel lifter includes an arm member pivotally connected to the frame and a suction member connected to the arm member for suctionly engaging the panel of the collapsed container.

14. An apparatus as defined in claim 11, wherein said second bottom panel folding means includes an elongate panel contact member overlying an erected container and positioned to contact a non-folded bottom panel to thereby fold the non-folded bottom panel inwardly toward a closed position.

15. An apparatus as defined in claim 11, wherein the third bottom panel folding means includes a panel guide positioned adjacent said adhesive applying means to guidingly lift the non-folded bottom panel inwardly to a folded position.

16. An apparatus as defined in claim 11, wherein the compressing means includes a wall member, a bottom panel compressing member spaced-apart from the wall member so that a container can readily be positioned therebetween, and retracting and extending means connected to the bottom panel compressing member for extending the compressing member into contact with surfaces of the bottom panel and for retracting the compressing member to a position so that another erected container can be positioned between the compressing member and the wall member.

17. An apparatus as defined in claim 11, wherein the conveying means includes an erected container guide and a drive connected to the erected container guide for driving the guide in the second predetermined path of travel between a position adjacent the second bottom panel closing means and a position adjacent said adhesive applying means.

18. An apparatus as defined in claim 11, wherein said adhesive applying means includes at least one glue head positioned to apply glue to bottom panels which were first to be folded prior to the folding of other bottom panels, the apparatus further comprising a third predetermined path of travel for conveying erected and sealed containers.

19. An apparatus as defined in claim 18, wherein the third bottom panel folding means also includes an upper panel guide member for further guiding the upper bottom panel folded by the second bottom panel folding means to a further folded position whereby the upper bottom panel abuttingly contacts the first to be folded bottom panels.

20. A container erecting and sealing apparatus for enhancing the production speed of container erecting and sealing, the apparatus comprising:

a container conveyor positioned along a second predetermined path of travel transverse to a first predetermined path of travel for receiving a plurality of erected containers from the first predetermined path of travel and conveying the plurality of erected containers along the second predetermined path of travel during simultaneous dispensing, erecting, and advancing of collapsed containers along a first predetermined path of travel;

a bottom panel folder positioned adjacent said container conveyor along the second predetermined path of travel for folding at least one non-folded bottom panel of each of the plurality of erected containers inwardly toward a closed position;

an adhesive applicator positioned downstream from the bottom panel folder along the second predetermined path of travel for applying adhesive only to selected portions of bottom panels of each of the plurality of erected containers during simultaneous folding of at least one non-folded bottom panel of another of the plurality of containers by the bottom panel folder; and a container panel compressor positioned downstream from the adhesive applicator along the second predetermined path of travel for compressing surfaces of the bottom panels of each of the plurality of containers to thereby seal the bottom panels in a closed position, during simultaneous application of adhesive to another of the plurality of containers by the adhesive applicator.

21. An apparatus as defined in claim 20, wherein the bottom panel folder includes a panel guide positioned adjacent said adhesive applicator to guidingly lift the non-folded bottom panel inwardly to a folded position.

22. An apparatus as defined in claim 21, wherein the container compressor includes a wall member, a bottom panel compressing member spaced-apart from the wall member so that a container can readily be positioned therebetween, and retracting and extending means connected to the bottom panel compressing member for extending the compressing member into contact with surfaces of the bottom panel and for retracting the compressing member to a position so that another erected container can be positioned between the compressing member and the wall member.

23. An apparatus as defined in claim 22, wherein the container conveyor includes an erected container guide and a drive connected to the erected container guide for driving the guide along the second predetermined path of travel.

24. An apparatus as defined in claim 23, wherein said adhesive applicator includes at least one glue head position to apply glue to the selected portions of the bottom panels.

25. An apparatus as defined in claim 24, wherein the bottom panel folder also includes an upper panel guide member for further guiding the upper bottom panel toward a closed position.

26. A method of erecting and sealing a flat container for enhancing the production speed of container erecting and sealing, the method comprising the steps of:

erecting each of a plurality of collapsed containers during travel along a first predetermined path, the plurality of collapsed containers each having a plurality of non-folded bottom panels, the bottom panels each having front and rear portions;

inwardly folding a pair of the plurality of non-folded bottom panels of each of the plurality of erected containers during advancement of the erected container downstream along the first predetermined path of travel;

inwardly folding the at least one of the non-folded bottom panels of each of the plurality of erected containers downwardly to thereby contact the folded bottom panels when each of the plurality of erected containers is positioned along the first predetermined path of travel;

conveying the plurality of erected containers along a second predetermined path of travel;

folding a remaining non-folded bottom panel of each of the plurality of erected containers inwardly to a position closely adjacent the previously folded bottom panels when the plurality of erected containers travel along the second predetermined path of travel;

applying adhesive only to selected portions of the bottom panels when each of the plurality of erected containers travel along the second predetermined path of travel; and compressingly contacting the front portion of the bottom panels against a cushioned wall member and rear portion of the bottom panels against a bottom panned compressing member when each of the plurality of erected containers travel along the second predetermined path of travel to thereby seal the bottom panels in a closed position.

27. A method as defined in claim 26, further comprising individually dispensing a plurality of stacked collapsed containers along the first predetermined path of travel prior to the step of erecting the plurality of collapsed containers.

28. A method of erecting and sealing containers, the method comprising the steps of:

receiving a plurality of erected containers from a first predetermined path of travel;

simultaneously conveying the plurality of erected containers along a second predetermined path of travel receiving another plurality of containers from the first predetermined path of travel;

folding at least one non-folded bottom panel of each of the plurality of erected containers inwardly toward a closed position during travel along the second predetermined path of travel;

simultaneously applying adhesive only to selected portions of bottom panels of each of the plurality of erected containers during travel along the second predetermined path of travel and folding at least one non-folded bottom panel of another of the plurality of containers; and simultaneously compressing surfaces of the bottom panels of each of the plurality of erected containers along a second predetermined path of travel to thereby and applying adhesive to selected portions of bottom panels of another plurality of containers.

29. A method as defined in claim 28, further comprising receiving each of the plurality of erected and sealed containers from the second predetermined path of travel and conveying each of the plurality of erected and sealed containers along a third predetermined path of travel.

30. A method as defined in claim 28, further comprising extending a bottom panel compressing member into portions of the erected containers to abuttingly contact and seal the bottom panels, retracting the bottom panel compressing member from the erected and sealed container, and advancing the erected and sealed container along a third predetermined path of travel.

* * * * *